US010532908B2

(12) United States Patent
Roberts et al.

(10) Patent No.: US 10,532,908 B2
(45) Date of Patent: Jan. 14, 2020

(54) THRUST AND MOMENT CONTROL SYSTEM FOR CONTROLLING LINEAR MOTOR ALIGNMENT IN AN ELEVATOR SYSTEM

(71) Applicant: Otis Elevator Company, Farmington, CT (US)

(72) Inventors: Randall Roberts, Hebron, CT (US); David Ginsberg, Granby, CT (US); Konda Reddy Chevva, Ellington, CT (US); Walter Thomas Schmidt, Marlborough, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 470 days.

(21) Appl. No.: 15/366,577

(22) Filed: Dec. 1, 2016

(65) Prior Publication Data

US 2017/0158461 A1 Jun. 8, 2017

Related U.S. Application Data

(60) Provisional application No. 62/263,037, filed on Dec. 4, 2015.

(51) Int. Cl.

| | |
|---|---|
| ***B66B 1/34*** | (2006.01) |
| ***B66B 1/30*** | (2006.01) |
| ***B66B 11/04*** | (2006.01) |
| ***B66B 9/00*** | (2006.01) |

(52) U.S. Cl.

CPC ..... *B66B 1/30* (2013.01); *B66B 9/003* (2013.01); *B66B 11/0407* (2013.01)

(58) Field of Classification Search

CPC ..... B66B 1/30; B66B 9/003; B66B 11/0407

USPC ..... 187/247, 409, 410, 292, 293, 296, 391, 187/393

See application file for complete search history.

(56) References Cited

U.S. PATENT DOCUMENTS

| | | | | |
|---|---|---|---|---|
| 4,839,543 A * | 6/1989 | Beakley | ..... | B25J 9/123 310/12.22 |
| 5,117,946 A | 6/1992 | Traktovenko et al. | | |
| 5,294,757 A | 3/1994 | Skalski et al. | | |

(Continued)

FOREIGN PATENT DOCUMENTS

| | | |
|---|---|---|
| CN | 1581643 A | 2/2005 |
| CN | 1313350 C | 5/2007 |

(Continued)

OTHER PUBLICATIONS

Chinese First Office Action for application CN 201611100595.3, dated Aug. 8, 2018, 10 pages.

*Primary Examiner* — Anthony J Salata
(74) *Attorney, Agent, or Firm* — Cantor Colburn LLP

(57) ABSTRACT

An elevator system includes a lane and at least one rail extending along the lane. An elevator car is arranged in the lane and is operatively coupled to the at least one rail. The elevator car has a predetermined alignment relative to the at least one rail. A propulsion system is operatively connected between the elevator car and the at least one rail. A thrust and moment control system is operatively connected to the propulsion system. The thrust and moment control system selectively controls the propulsion system to substantially maintain the predetermined alignment of the elevator car relative to the at least one rail.

15 Claims, 3 Drawing Sheets

(56) References Cited

U.S. PATENT DOCUMENTS 5,542,501 A * 8/1996 Ikejima ..... B66B 1/30 187/289
5,862,886 A 1/1999 Bennett et al.
5,934,198 A * 8/1999 Fraser ..... B61B 5/02 104/119
6,401,872 B1 * 6/2002 Morishita ..... B66B 7/042 187/292
6,959,787 B2 * 11/2005 Husmann ..... B66B 7/046 187/292
7,007,774 B2 * 3/2006 Utsunomiya ..... B66B 7/042 187/292
7,261,186 B2 * 8/2007 Deplazes ..... B60L 13/10 187/277
7,314,119 B2 1/2008 Husmann et al.
7,621,377 B2 11/2009 Husmann
7,931,128 B2 4/2011 Sakai et al.
7,992,689 B2 8/2011 Stolt et al.
8,141,685 B2 * 3/2012 Utsunomiya ..... B66B 11/028 187/292
8,205,721 B2 6/2012 Korhonen et al.
8,746,411 B2 6/2014 Roberts et al.
2011/0303493 A1 12/2011 Hubbard et al.
2017/0015524 A1 * 1/2017 Fargo ..... B66B 11/0407
2017/0036887 A1 * 2/2017 Roberts ..... H02K 41/031
2017/0057784 A1 * 3/2017 Witczak ..... B66B 7/02
2018/0022573 A1 * 1/2018 Hsu ..... B66B 1/2466 187/247

FOREIGN PATENT DOCUMENTS

CN 101016135 A 8/2007
CN 101875464 A 11/2010
CN 202704767 U 1/2013
CN 102963783 A 3/2013
CN 104876099 A 9/2015
CN 204661056 U 9/2015
EP 1547956 B1 9/2007
GB 2151420 A 7/1985
WO 2006119787 A1 11/2006
WO 2008136692 A2 11/2008
WO 2010104502 A1 9/2010
WO 2015063722 A1 5/2015

* cited by examiner

THRUST AND MOMENT CONTROL SYSTEM FOR CONTROLLING LINEAR MOTOR ALIGNMENT IN AN ELEVATOR SYSTEM

CROSS-REFERENCE TO RELATED APPLICATIONS

This application claims the benefit of U.S. provisional patent application Ser. No. 62/263,037, filed Dec. 4, 2015, the entire contents of which are incorporated herein by reference.

BACKGROUND

Exemplary embodiments pertain to the art of elevator systems and, more particularly, to a thrust and moment control system for an elevator system.

Ropeless elevator systems, also referred to as self-propelled elevator systems, are useful in certain applications (e.g., high rise buildings) where the mass of the ropes for a roped system is prohibitive, and there is a desire for multiple elevator cars to travel in a single lane. In certain cases, the self-propelled elevator includes a single propulsion system arranged between a lateral side of an elevator car and a guide rail. It is advantageous to maintain a desired alignment between movable and stationary components of the propulsion system, as well as between the elevator car and associated guide rails, in order to reduce wear and tear on drive and guide components.

BRIEF DESCRIPTION

Disclosed is an elevator system including a lane and at least one rail extending along the lane. An elevator car is arranged in the lane and is operatively coupled to the at least one rail. The elevator car has a predetermined alignment relative to the at least one rail. A propulsion system is operatively connected between the elevator car and the at least one rail. A thrust and moment control system is operatively connected to the propulsion system. The thrust and moment control system selectively controls the propulsion system to substantially maintain the predetermined alignment of the elevator car relative to the at least one rail.

In addition to one or more of the features described above, or as an alternative, further embodiments may include wherein the thrust and moment control system selectively adjusts an applied effective moment delivered to the elevator car through the propulsion system.

In addition to one or more of the features described above, or as an alternative, further embodiments may include wherein the propulsion system includes a moving portion mounted to the elevator car and a fixed portion mounted in the lane, the moving portion being spaced from the fixed portion by a predetermined gap.

In addition to one or more of the features described above, or as an alternative, further embodiments may include wherein the moving portion includes a first motor secondary portion and a second motor secondary portion spaced from the first motor secondary, the fixed portion extending between the first and second motor secondaries.

In addition to one or more of the features described above, or as an alternative, further embodiments may include one or more sensors mounted to the elevator car and operatively connected to the thrust and moment control system, the sensor being configured to sense the predetermined gap.

In addition to one or more of the features described above, or as an alternative, further embodiments may include wherein the thrust and moment control system selectively controls the propulsion system to substantially maintain the predetermined gap.

In addition to one or more of the features described above, or as an alternative, further embodiments may include a feedback sensor operatively connected to the sensor and the thrust and moment control system, the feedback system being configured and disposed to signal the thrust and moment control system to substantially maintain the predetermined gap as the elevator car travels along the lane.

Also disclosed is a method of counteracting imbalanced loads in a ropeless elevator system. The method includes sensing a misalignment of an elevator car, activating a propulsion system to shift an elevator car along a lane, and controlling the propulsion system to compensate for the misalignment of the elevator car.

In addition to one or more of the features described above, or as an alternative, further embodiments may include wherein controlling the propulsion system includes adjusting an applied effective moment to the elevator car.

In addition to one or more of the features described above, or as an alternative, further embodiments may include wherein sensing the misalignment includes detecting a deviation from a predetermined alignment of the elevator car resulting from a load imbalance.

In addition to one or more of the features described above, or as an alternative, further embodiments may include wherein sensing the misalignment includes detecting a deviation from a predetermined alignment of the elevator car relative to a rail extending along the lane.

In addition to one or more of the features described above, or as an alternative, further embodiments may include wherein sensing the misalignment includes detecting a change in a gap between a moving portion and a fixed portion of the propulsion system.

In addition to one or more of the features described above, or as an alternative, further embodiments may include wherein sensing the misalignment includes detecting a change in a gap between at least one of a first motor secondary portion and a second motor secondary portion of the moving portion and the fixed portion of the propulsion system.

In addition to one or more of the features described above, or as an alternative, further embodiments may include wherein controlling the propulsion system includes delivering a thrust to the elevator car causing a rotation about at least one axis.

In addition to one or more of the features described above, or as an alternative, further embodiments may include controlling the propulsion system to compensate for misalignments as the elevator car travels along the lane.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
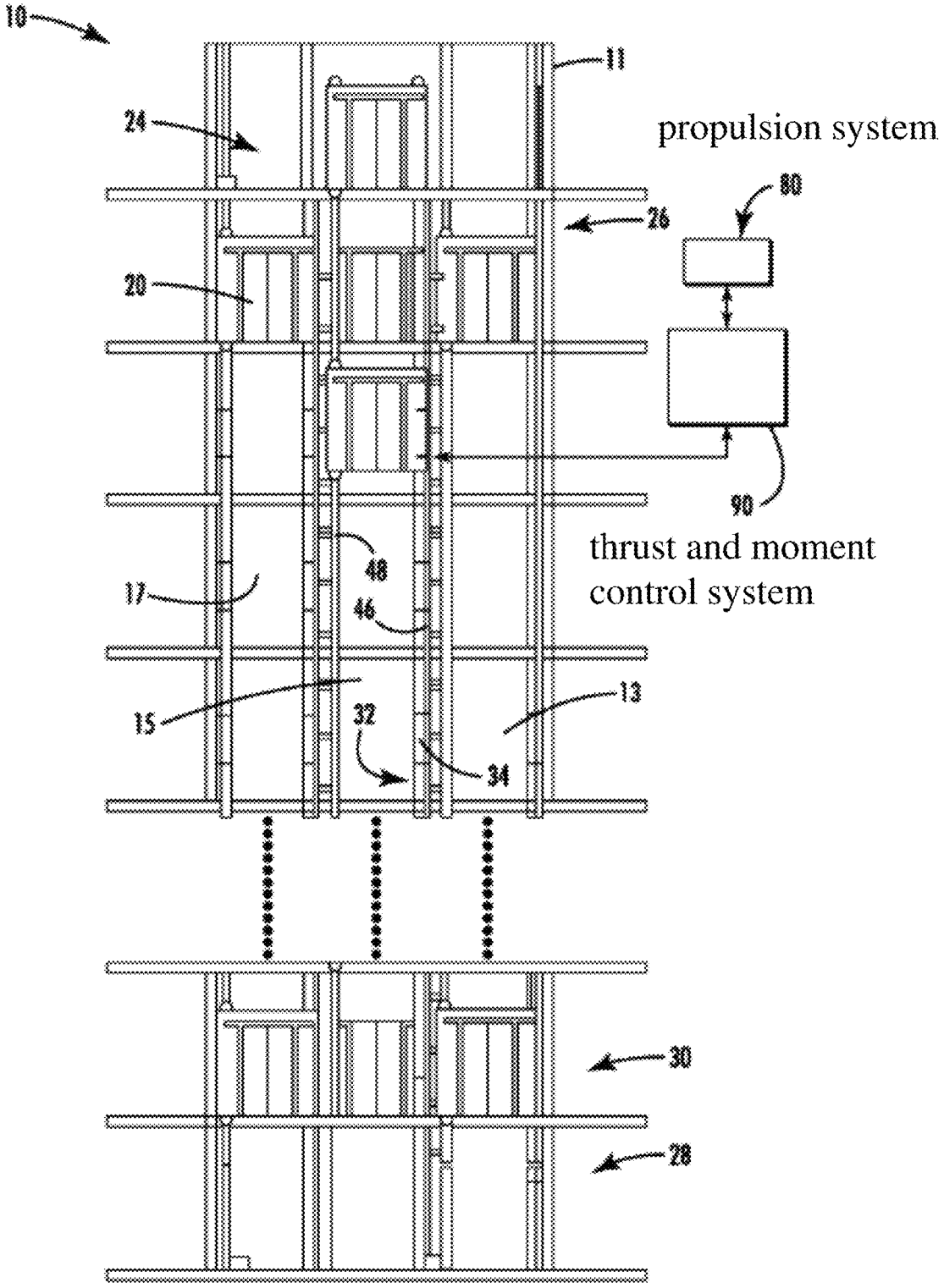
FIG. 1 illustrates a multicar ropeless (MCRL) elevator system having an elevator car thrust and moment control system, in accordance with an aspect of an exemplary embodiment.
Figure 2:
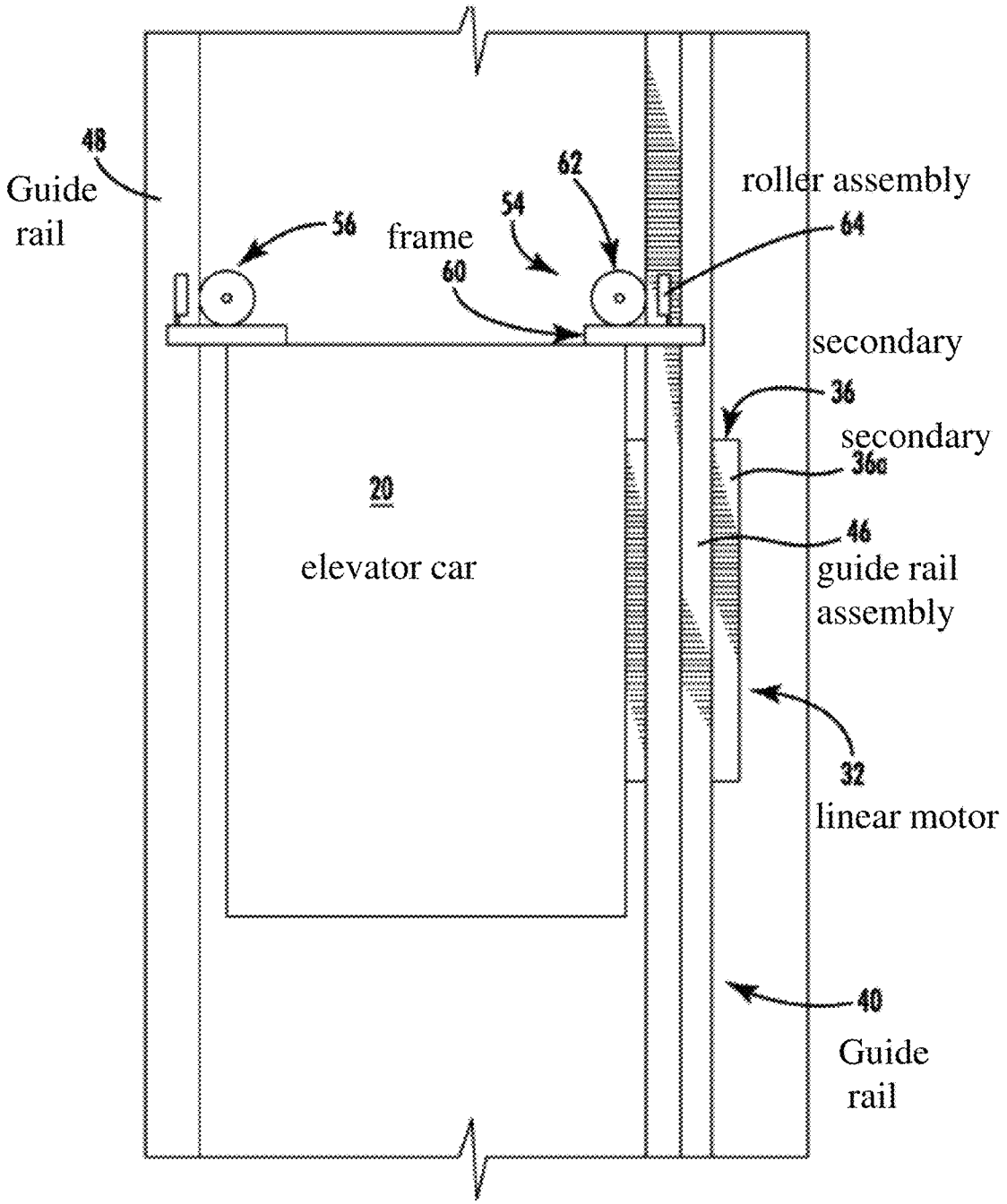
FIG. 2 is a schematic illustration of one elevator car of the MCRL elevator system of FIG. 1, in accordance with an aspect of an exemplary embodiment.

Referring to FIGS. 1 and 2, a multicar ropeless (MCRL) elevator system 10 is illustrated according to one embodiment. Elevator system 10 includes a hoistway 11 having a plurality of lanes 13, 15 and 17. While three lanes are shown in FIG. 1, it is understood that embodiments may be used with multicar ropeless elevator systems that have any number of lanes. In each lane 13, 15 and 17, elevator cars 20 travel in one direction, i.e., up or down, or in multiple directions (i.e., both up and down). For example, in FIG. 1 elevator cars 20 in lanes 13 and 17 travel up and elevator cars 20 in lane 15 travel down. One or more elevator cars 20 may travel in a single lane 13, 15 and 17.

In the exemplary embodiment shown, an upper transfer station 24 may be located above a top most floor 26. Upper transfer station 24 facilitates horizontal travel of one or more elevator cars 20 between select ones of lanes 13, 15 and 17. It is understood that upper transfer station 24 may be located at top most floor 26. A lower transfer station 28 may be arranged below a first floor 30. In a manner similar to that described above, lower transfer station 28 facilitates horizontal travel of one or more of elevator cars 20 between select ones of lanes 13, 15 and 17. It is understood that lower transfer station 28 may be located at first floor 30. Although not shown in FIG. 1, one or more intermediate transfer stations may be used between lower transfer station 28 and upper transfer station 24. Intermediate transfer stations may be similar to lower transfer station 28 and/or upper transfer station 24. Additionally, both lower transfer station 28 and upper transfer station 24 may be at system terminals, or at any floor above or below. Therefore, it is to be understood that upper transfer station 24 represents an upper most transfer station in MCRL elevator system 10, and lower transfer station 28 represents a lower most transfer station in MCRL elevator system 10.

Transfer stations at various locations advantageously impact the functional capability of the system by increasing loop options. For example, the lanes 13, 15 and 17 may include elevator cars 20 traveling in a uni-directional or bi-directional manner. Furthermore, parking of elevator cars 20 may be performed in transfer stations 24 and 28 depending on the particular location and configuration. Therefore, the term "transfer station" should be understood to include a location in which elevator cars 20 may be shifted between lanes 13, 15 and 17 and/or a location in which elevator cars may be transferred out of service and parked. An elevator car may be "parked" during times of off-peak usage, for routine maintenance, and/or repair.

Figure 3:
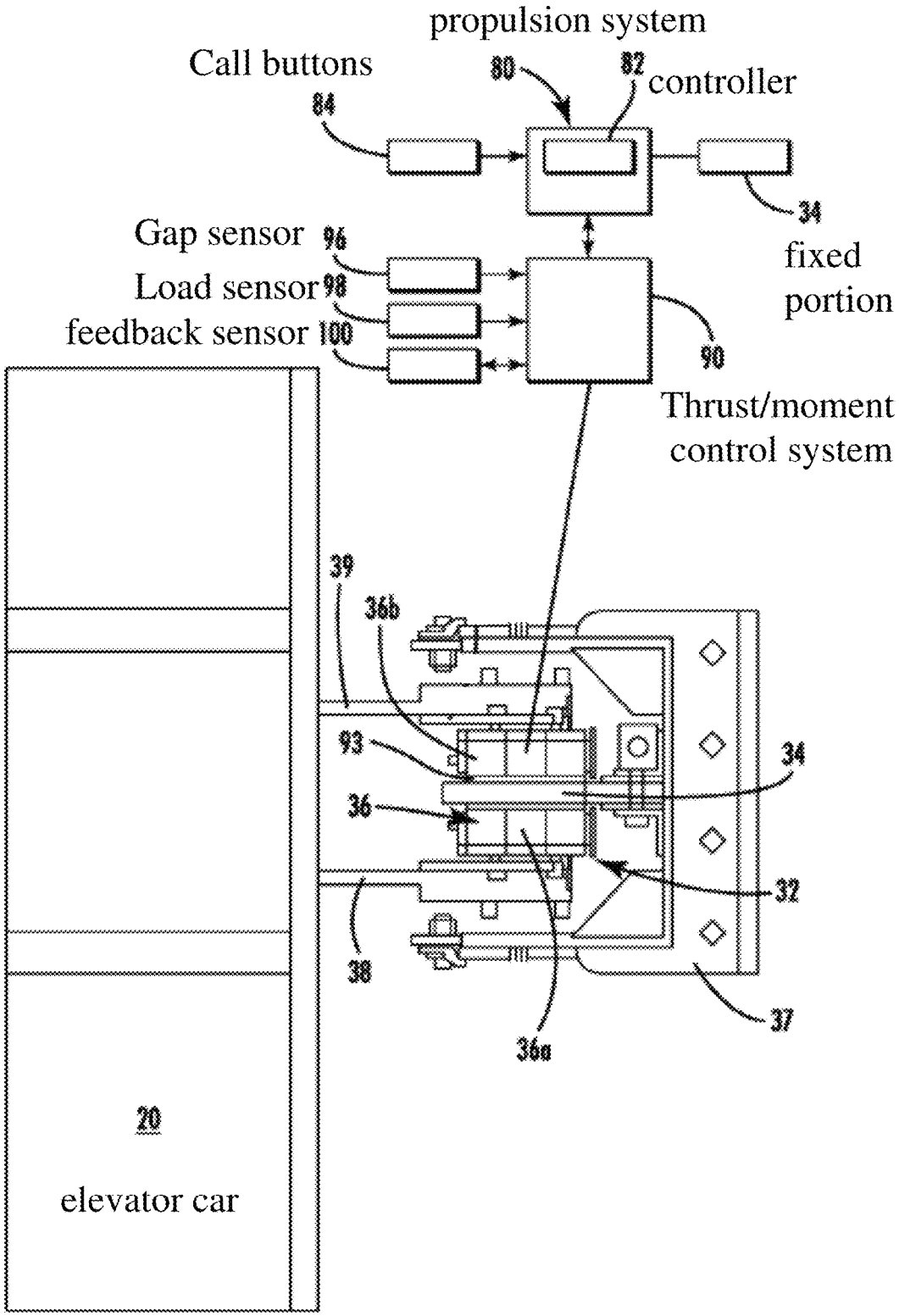
FIG. 3 depicts a bottom view of the elevator car and elevator car alignment system, in accordance with an exemplary embodiment.

Elevator cars 20 are self-propelled using, for example, a linear motor system 32 having multiple drive components, such as one or more fixed portions or motor primaries 34 and one or more moving portions or motor secondaries 36 (FIG. 2). It should be noted that an additional linear motor systems (not separately labeled) may operate on concert with linear motor system 32 to shift or motivate elevator car 20 along one or more of lanes 13, 15, and 17. Further, it should be understood that the number and arrangement of linear motor systems may vary. In the exemplary embodiment shown, the one or more fixed portions 34 are mounted to a support rail 37 and extend along, lanes 13, 15 and 17. The one or more moving portions 36 include first and second motor secondary portions 36*a* and 36*b* mounted on first and second support rails 38 and 39 extending from elevator car 20 (FIG. 3). In accordance with an aspect of an exemplary embodiment, moving portion(s) 36 is/are positioned and arranged to disengage from fixed portion(s) 34 allowing elevator car 20 to freely translate or horizontally shift into, for example, one or the other of upper transfer station 24 and lower transfer station 28 as well as any transfer stations that may be arranged therebetween.

As shown in FIG. 2, elevator car 20 is guided by one or more guide structures or rails 40 extending along the length of lane 15. Guide structure 40 may be affixed to a hoistway wall (not separately labeled), a propulsion device (not separately labeled), a carriage structural member (also not separately labeled), or stacked over each other. For ease of illustration, the view of FIG. 2 only depicts a single side guide structure 40; however, there may be two or more guide structures 40 positioned, for example, on opposite sides of elevator car 20. Guide structure 40 may include a first guide rail assembly 46 and a second guide rail assembly 48. Elevator car 20 may include a first roller system 54 that operatively engages with first rail assembly 46 and a second roller system 56 that operatively engages with second rail assembly 48. First roller system 54 is supported from elevator car 20 by a frame 60 and includes a first roller assembly 62 and a second roller assembly 64. Second roller system 56 may include similar structure.

In accordance with an exemplary embodiment, elevator system 10 includes a propulsion system 80 that selectively delivers power to motor primary 34 to shift elevator car 20 along a respective one or more of lanes 13, 15, and 17. As shown in FIG. 3, propulsion system 80 may include a controller 82 that shifts elevator car 20 to a selected floor (not separately labeled) based on inputs received through, for example, one or more call buttons 84. Controller 82 may take the form of a single, integrated system, or a number of operatively associated components that may be co-located, or distributed along, for example, one or more of lanes 13, 15, and 17. Call buttons 84 may be arranged in elevator car 20 and/or at each floor.

In further accordance with an exemplary embodiment, elevator system 10 includes a thrust and moment control system 90 operatively connected to propulsion system 80. It should be understood that while shown as a single controller, thrust and moment control system 90 may take the form of multiple components that are co-located or arranged remote from one another. As will be detailed more fully below, thrust and moment control system 90 signals propulsion system 80 to adjust an applied effective moment to elevator car 20 through linear motor 32. The adjustment of applied effective moment selectively shifts elevator car 20 about one or more axes in order to accommodate any imbalance in load that may result from an uneven distribution of goods and or people in elevator car 20.

Thrust and moment control system 90 detects any deviation from a predetermined alignment between elevator car 20 and, for example, guide rail structure 40. In accordance with an aspect of an exemplary embodiment, thrust and moment control system 90 monitors a gap 93 that exists between motor primary 34 and one or more of first and second motor secondaries 36*a* and 36*b*. The location of gap 93, e.g., the particular orientation of gap 93 may vary depending upon the number, location, and positions of linear motor systems. In accordance with an aspect of an exemplary embodiment, a sensor 96 may be operatively connected to thrust and moment control system 90 and mounted to support rail 39 and directed to monitor gap 93. Sensor 96 may be configured to detect changes in gap 93. For example, sensor 96 may detect if/when gap 93 deviates from a predetermined dimension. In accordance with other aspects of an exemplary embodiment, additional sensors, such as a load sensor 98 may be employed to detect misalignments of elevator car 20. Further, gap 93 may be determined indirectly such as by determining particular locations of one or more points on elevator car 20 relative to, for example, guide rail structure 40.

In further accordance with an exemplary embodiment, thrust and moment control system 90 may receive inputs from one or more of sensors 96 and 98 indicating a misalignment of elevator car 20. For example, occupants in elevator car 20 may enter and stand to one side or another of a car centerline (not separately labeled). Upon detecting a misalignment, thrust and moment control system 90 signals propulsion system 80 to create a counter acting force when activating liner motor 32. The counter acting force causes elevator car 20 to pitch or roll about the centerline to substantially counteract any load imbalance. Depending upon the number of linear motors employed, thrust and moment control system 90 may operate propulsion system 80 to cause elevator car 20 to pitch and roll about the centerline.

In still further accordance with an exemplary embodiment, thrust and moment control system 90 may include a feedback sensor 100 that operates autonomously or in combination with one or more of sensors 96 and 98 to monitor for any misalignments of elevator car 20 while passing along a respective one of lanes 13, 15, and 17. Thrust and moment control system 90 may adjust applied effective thrust to elevator car 20 to compensate for dynamic misalignments that may occur as elevator car 20 moves between floors. Further, thrust and moment control system 90 may monitor sensors 96 and/or 98 to evaluate any effect changes in applied effective thrust may have on elevator car 20. In this manner, thrust and moment control system 90 may make further adjustments to ensure that elevator car 20 remains substantially in a desired alignment. Of course, it should be understood that a variety of systems may be employed to monitor for and effect changes in applied effective load and ensure that elevator car 20 remains in the desired alignment. It should also be understood that the number, type and location, and/or configuration of sensors 96 and/or 98 may vary.

At this point, it should be understood that exemplary embodiments describe a thrust and moment control system for a ropeless elevator system. The thrust and moment control system interacts with a propulsion system to adjust elevator car orientation to accommodate imbalances. The thrust and moment control system includes one or more sensors that not only determine that an elevator car may be misaligned, but also monitors applied corrective thrust to ensure that a desired effective moment is applied. By monitoring for and adjusting misalignments, the thrust and moment control system in accordance with exemplary embodiments, ensures that desired tight or close tolerances may be maintained in elevator system 20 without leading to an increase in maintenance or repair that may be caused by undesirable loading of the guide structure. Further, it should be understood that the number and location of linear motors controlled by the thrust and moment control system may vary as well as the number of possible/potential degree-of freedom (DOF) changes of elevator car 20 to accommodate misalignments.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. An elevator system comprising:

a lane;

at least one rail extending along the lane;

an elevator car arranged in the lane and operatively coupled to the at least one rail, the elevator car having a predetermined alignment relative to the at least one rail;

a propulsion system operatively connected between the elevator car and the at least one rail; and a thrust and moment control system operatively connected to the propulsion system, the thrust and moment control system selectively controlling the propulsion system to substantially maintain the predetermined alignment of the elevator car relative to the at least one rail;

wherein the propulsion system includes a moving portion mounted to the elevator car and a fixed portion mounted in the lane, the moving portion being spaced from the fixed portion;

wherein the thrust and moment control system selectively controls the propulsion system to substantially maintain alignment of the elevator system.

2. The elevator system according to claim 1, wherein the thrust and moment control system selectively adjusts an applied effective moment delivered to the elevator car through the propulsion system.

3. The elevator system according to claim 1, wherein the propulsion system includes a moving portion mounted to the elevator car and a fixed portion mounted in the lane, the moving portion being spaced from the fixed portion by a predetermined gap.

4. The elevator system according to claim 3, wherein the moving portion includes a first motor secondary portion and a second motor secondary portion spaced from the first motor secondary, the fixed portion extending between the first and second motor secondaries.

5. The elevator system according to claim 3, further comprising: one or more sensors mounted to the elevator car and operatively connected to the thrust and moment control system, the sensor being configured to sense the predetermined gap.

6. The elevator system according to claim 3, wherein the thrust and moment control system selectively controls the propulsion system to substantially maintain the predetermined gap.

7. The elevator system according to claim 3, further comprising: a feedback sensor operatively connected to the sensor and the thrust and moment control system, the feedback system being configured and disposed to signal the thrust and moment control system to substantially maintain the predetermined gap as the elevator car travels along the lane.

8. A method of counteracting imbalanced loads in a multicar ropeless elevator system, the method comprising:

sensing a misalignment of an elevator car;

activating a propulsion system to shift an elevator car along a lane; and controlling the propulsion system to compensate for the misalignment of the elevator car;

wherein sensing the misalignment includes detecting a change in a predetermined gap between a moving portion and a fixed portion of the propulsion system;

wherein controlling the propulsion system to compensate for the misalignment of the elevator car comprises controlling the propulsion system to substantially maintain the predetermined gap.

9. The method of claim 8, wherein controlling the propulsion system includes adjusting an applied effective moment to the elevator car.

10. The method of claim 8, wherein sensing the misalignment includes detecting a deviation from a predetermined alignment of the elevator car resulting from a load imbalance.

11. The method of claim 8, wherein sensing the misalignment includes detecting a deviation from a predetermined alignment of the elevator car relative to a rail extending along the lane.

12. The method of claim 8, wherein sensing the misalignment includes detecting a change in a gap between at least one of a first motor secondary portion and a second motor secondary portion of the moving portion and the fixed portion of the propulsion system.

13. The method of claim 8, wherein controlling the propulsion system includes delivering a thrust to the elevator car causing a rotation about at least one axis.

14. The method of claim 8, further comprising: controlling the propulsion system to compensate for misalignments as the elevator car travels along the lane.

15. The elevator system according to claim 1, wherein the propulsion system includes at least two fixed portions, wherein at least one of the fixed portions generates a counteracting force to control alignment of the elevator system.

* * * * *